United States Patent [19]

Bauer et al.

[11] Patent Number: 4,771,889

[45] Date of Patent: Sep. 20, 1988

[54] PACKAGED FOOD CASING ARTICLE WITH ATTACHED SPLICE TAPE

[75] Inventors: Michael R. Bauer, Oak Lawn; Robert P. Graves, Jr., Downers Grove, both of Ill.

[73] Assignee: Viskase Corporation, Chicago, Ill.

[21] Appl. No.: 63,031

[22] Filed: Jun. 17, 1987

[51] Int. Cl.[4] ..... B65D 85/671; B65B 5/10

[52] U.S. Cl. ..... 206/390; 53/430; 206/395; 206/494; 206/802; 206/820; 242/58.1; 285/18; 426/138

[58] Field of Search ..... 206/390, 413, 389, 403, 206/494, 395, 396, 802, 820; 426/138, 140; 270/45, 43; 383/62; 53/430, 117, 118, 389; 242/58.1; 285/18, 260

[56] References Cited

U.S. PATENT DOCUMENTS

| | | | |
|---|---|---|---|
| 494,907 | 4/1893 | Turner | 426/140 |
| 3,051,583 | 6/1959 | Tindall . | |
| 3,178,095 | 12/1963 | Hennefent . | |
| 3,412,926 | 7/1967 | Bostwick . | |
| 3,587,840 | 6/1971 | Hultberg | 206/395 |
| 4,008,851 | 2/1977 | Hirsch | 383/62 |
| 4,032,176 | 6/1977 | Tabary . | |
| 4,066,167 | 1/1978 | Hanna et al. . | |
| 4,201,029 | 5/1980 | Lerner et al. . | |

FOREIGN PATENT DOCUMENTS 3318373 11/1984 Fed. Rep. of Germany .

OTHER PUBLICATIONS 3 pages from Badger Plug Co. Pamphlet.
1 page from Homasote Company Pamphlet.

*Primary Examiner*—Stephen Marcus
*Assistant Examiner*—Bryon Gehman
*Attorney, Agent, or Firm*—Roger Aceto

[57] ABSTRACT

A packaged food casing article includes a dispensing carton, a roll of casing rotatably supported within the carton, and a strip of splice tape releasably attached to a carton closure flap. The tape as oriented on the flap extends transverse to the casing dispensing direction and is attachable to an end of the casing when effecting a splice to the casing length being dispensed from the carton. The flap maintains the splice tape in a proper orientation during splicing and provides a work surface against which the casing is pressed for effecting the splice.

10 Claims, 2 Drawing Sheets

PACKAGED FOOD CASING ARTICLE WITH ATTACHED SPLICE TAPE

TECHNICAL FIELD

The present invention relates to a packaged food casing article for use in stuffing a food product and in particular to such an article including a supply of food casing contained in a dispensing carton and means associated with the carton for splicing the casing end to the end of another casing supply.

BACKGROUND OF THE INVENTION

Large diameter food casings are used by food processors for stuffing large diameter sausages such as bolognas or the like and for stuffing large muscle groups. The principal commercial large muscle group which is stuffed is boned hams.

Large diameter food casings used for stuffing are generally made of regenerated cellulose with a fibrous reinforcing web embedded in the wall of the casing. The casing (hereinafter "fibrous casing") is moisturized by the casing manufacturer to provide the extensibility required for stuffing. In one stuffing method, the fibrous casing used for stuffing large muscle groups is flattened and reeled into a roll which contains upwards of one thousand or more feet of casing.

In use the roll of the flat fibrous casing is placed on a supply reel of a stuffing machine. Casing drawn from the supply reel is laced through a system of feed rolls, opened and then pulled over the discharge end of a stuffing horn. A food product (usually a whole boneless ham) is then pushed through the stuffing horn into the opened casing. In such an apparatus as disclosed, for example, in U.S. Pat. Nos. 3.919,739 and 4,534,084 the progression of the casing over the stuffing horn is in a direction opposite to the stuffing direction.

In this type of apparatus, the feed rolls are some distance (about six feet) from the discharge end of the stuffing horn. Operation of the stuffing machine requires that stuffing occur while there is still casing captured between the feed rolls. Accordingly, a new supply of casing is required before the trailing end of the casing leaves the feed rolls. This means that the last six feet or so of casing from each roll is not stuffed and is wasted.

After a supply roll is exhausted, it is customary to place a new roll of casing on the supply reel and again lace the casing through the system of feed rolls. This procedure of mounting a fresh roll of casing to the machine and then lacing the fibrous casing through the system of feed rolls is labor intensive, time consuming, and wastes the last six feet or so of casing from each roll. Accordingly, it is an object of the present invention to eliminate the need to lace the fibrous casing through the feed rolls each time a new supply of casing is required.

A further object of the present invention is to provide a packaged casing article wherein the fibrous casing is dispensed directly from its shipping carton thereby eliminating the need for mounting a roll ot fibrous casing to the supply reel of a stuffing machine.

Yet another object of the present invention is to provide a packaged casing article containing a relatively heavy load of fibrous casing including means to facilitate handling of the packaged article.

A still further object of the present invention is to provide a packaged food casing article including means for effecting a splice between lengths of casing so that the trailing end of one casing length can be spliced to the leading end of a second casing length thereby eliminating the need for lacing casing through the system of feed rolls each time a fresh supply of casing is required.

SUMMARY OF THE INVENTION

The packaged food casing article of the present invention may be characterized by:

(a) a dispensing carton having a bottom. two side walls and two end walls upstanding from about the periphery of said bottom and an open top;

(b) a flap attached to and extending along an upper edge of one of said end walls, said flap being foldable along said attached upper edge between an open and a closed position;

(c) said flap having a flat work surface which faces into said carton when said flap is in said closed position and which faces out of said carton when said flap is in said open position;

(d) a supply of flattened food casing in said carton arranged for continuous dispensing through said open top and over an upper edge of one of said end walls:

(e) a strip of pressure sensitive adhesive splice tape at least twice as long as the flat width of said casing, said tape including a backing which has one face releasably attached to said work surface and an adhesive layer on an opposite face, said strip of tape extending in its longitudinal direction across said work surface generally parallel to said attached upper edge and transverse to the dispensing direction of casing from said carton; and (f) a release lining over said splice tape which is removable when said flap is in said open position to expose the adhesive layer of said tape for adhesive attachment to an end of said casing dispensed from said carton and pressed against said tape and work surface.

In the present invention one thousand (1,000) or more feet of flattened fibrous casing is wound on a roll and placed in a paperboard carton. Preferably, the roll is supported on a reel within the carton. The reel includes a rigid support frame which suspends the roll within the carton so the roll is free to rotate.

Depending on the size (flat width) of the casing and its length, the total weight of the casing roll may be upwards of seventy (70) pounds. At this weight, it is difficult and awkward to move the carton by hand. Merely grasping and lifting the carton may cause the relatively heavy contents to break through the carton bottom. Accordingly, to facilitate handling the carton and its contents, a preferred embodiment of the carton of the present invention has openings at opposite sides which align with hand grips in the rigid support frame of the reel within the carton. The carton openings provide access to the hand grips to facilitate lifting or moving the carton. When lifting the carton by hand, the operator extends a hand into the carton openings and grips the frame. When gripped and lifted in this fashion, the rigid support frame and not the carton bottom, bears the load of the roll of casing.

Since the reel is free to rotate in the carton there is no need to remove the reel from the carton for mounting to the stuffing machine. Instead the carton is placed adjacent to the machine and opened. The casing is pulled from the roll and laced through the system of feed rolls of the stuffing machine. During stuffing, the casing unwinds from the roll and dispenses through the opened top of the carton and over an upper edge of one of the ends of the carton.

The stuffing machine may operate for several hours on one roll of casing. Prior to the present invention, when the roll of casing was exhausted, it was customary to stop the stuffing operation and to lace casing from a fresh supply through the system of feed rolls. A packaged casing article according to the present invention eliminates the need to stop the stuffing operation by providing means for effecting a splice between the trailing end of one casing length and the leading end of another.

In making a splice, the two casing ends to be joined are butted one against another (or are telescoped one into another) and then are wrapped with an adhesive tape to join the two ends. The present invention facilitates the splicing operation by providing the carton with at least one flap member which is foldable from the carton to an open position. Preferably, the flap member is attached to the carton along an upper edge thereof so it comprises a part of the means for closing the carton. One surface of the flap defines a flat work surface on which an end of the casing in the carton is spliced to an end of casing from another carton.

Located on the work surface of the flap is a length of splice tape. The backing of the splice tape is releasably attached to the flap with a glue spot or other suitable release means. A release lining over the adhesive layer of the tape prevents the tape from sticking to itself and prevents other premature or accidental adherence to the tape. Preferably, the tape is slightly longer than twice the flat width of the casing to be spliced and is arranged on the flap so its longitudinal direction extends generally transverse to the casing dispensing direction and generally parallel to the upper edge over which the casing is dispensed from the carton. This locates and maintains the longitudinal direction of tape parallel to the flat width direction of the casing being dispensed from the carton so the tape is in a proper position for effecting a splice.

The splice tape is not removed from the work surface of the flap while the splice is being made. Instead, the operator simply removes the release lining and while the tape is still attached to the flap work surface, presses an end of one casing length directly against the adhesive layer of the tape. An end of a second casing length also is pressed against the adhesive layer. The ends of the splice tape are then folded over and pressed against the casing ends to be joined to complete the splice.

Since the tape is oriented on the flap work surface with its longitudinal direction transverse the dispensing direction (i.e., parallel to the casing ends to be joined). The tape and the end of the casing in the carton are inherently oriented in a proper position for splicing. There is no need for the operator to manipulate either the splice tape or the casing to provide the proper orientation between the two for splicing casing from one carton to casing from another carton. Pressing the casing against the splice tape at the work surface and then folding and pressing the splice tape to the casing are accomplished while the tape is attached to the flap. In this manner the operator is assisted in making the splice by the flat work surface of the flap, the predisposition of the tape on the work surface in a proper orientation for making the splice, and the maintenance of the tape in the proper orientation while the splice is being made. This assistance is not inconsequential because the stuffing environment is usually maintained at a relatively cool temperature and the machine operators customarily wear gloves which interfere with their fine motor movement and the sense of touch required for manually making the splice. After a splice is made, the spliced ends of casing are simply lifted to release the splice tape from the flap.

DETAILED DESCRIPTION OF THE INVENTION

Figure 1:
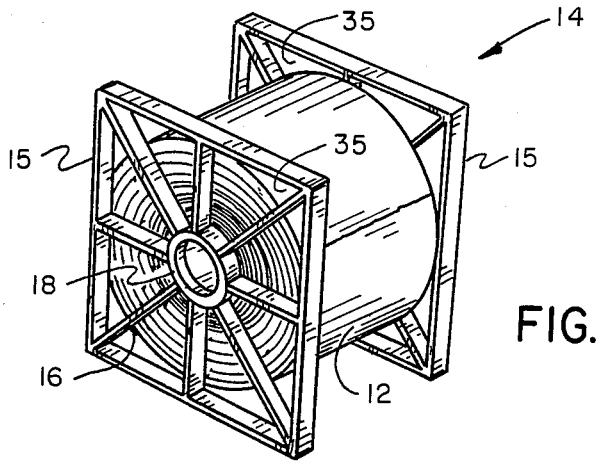
FIG. 1 is a perspective view showing a roll of casing and a support reel.

Referring to the drawings, FIG. 1 shows a roll 12 of food casing. The food casing contained in the roll is preferably a fibrous cellulosic casing as described hereinabove but may also be made of a tubular thermoplastic film.

The roll 12 is supported by a reel generally indicated at 14. The reel 14 is a conventional item and comprises a frame composed of two end plates 15. Each end plate 15 includes a spider 16 which supports a central hub 18 on which the roll 12 of casing is mounted. When located in the carton, as shown in FIG. 2, the reel 14 suspends the roll of casing within the carton so the roll is free to rotate within the carton.

Figure 2:
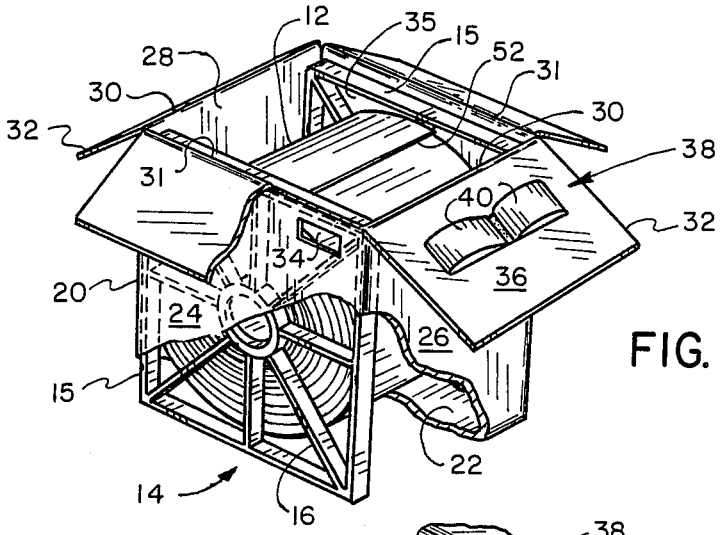
FIG. 2 is a perspective view showing the casing and reel of FIG. 1 disposed in a dispensing carton according to the present invention, the carton being in an open position.

FIG. 2 shows the roll 12 of casing and reel 14 disposed in a dispensing carton 20. The carton has a bottom 22, a pair of opposite side walls 24 and two opposite end walls 26 upstanding from about the periphery of the bottom, and an open top 28. Adjacent the upper edge 31 of each side wall 24 at diagonally opposite corners of the carton is a hand opening 34. The opening aligns with a space 35 between the legs of spider 16 so the carton openings 34 provide access to each space 35. With this arrangement an operator can extend his hand through the carton openings 34 and into the space 35 to grasp the end plates 15. When the carton is lifted, the weight of the casing roll is born by the reel 14 and not by the bottom 22 of the carton.

The roll of casing is arranged within the carton for dispensing over an upper edge 30 of one of the opposite end walls 26.

Attached to and extending along each upper edge 30 is an end flap 32. The end flaps are foldable along each upper edge 30 to at least partly close the open top of the carton. Each end flap 32 has a flat working surface 36 which faces into the carton when the flap is closed and which faces out of the carton (as shown) when the flap is open.

Releasably attached to at least one of these working surfaces 36 is a strip of pressure sensitive adhesive tape generally indicated at 38. For purposes set out hereinbelow, the strip of tape is oriented so its longitudinal direction extends across the end flap 32 in the same general direction as edge 30 and preferably it extends generally parallel to the edge. The backing of the tape is attached to the working surface by any suitable means (not shown) such as glue spots or a double sided tape which allows the splicing tape 38 to be removed from the working surface 36.

Figure 3:
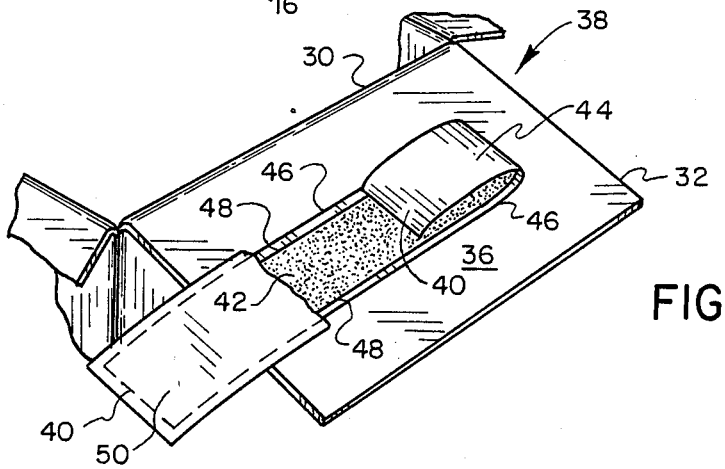
FIG. 3 is a view on an enlarged scale showing the flat work surface-splice tape assembly of the dispensing carton.

As best seen in FIG. 3, the pressure sensitive splice tape 38 is longer than the width of flap 32. In order to wrap completely around the casing, the tape 38 has a length which is at least twice the flat width of the casing 12. Due to the length of the splice tape 38, its two ends 40 are folded over (as shown in FIG. 1) so that when flap 32 is in a closed position the tape is wholly within the carton.

The adhesive layer of the tape is composed of any suitable material which is capable of adhering to the casing 12. When using a premoisturized fibrous casing the splice tape 38 preferably is composed of two separate adhesive tapes superimposed one over the other. A first inner tape 42 has a polyethylene backing and an acrylic based adhesive layer. The second tape 44 has a nylon backing and a cured rubber based adhesive layer. Moreover the second tape is wider than the first so that the adhesive at the lateral side margins 46 of the second tape overlap the corresponding side edges 48 of the first tape.

Disposed over the adhesive surface of tape 38 is a release lining 50. This release lining 50 prevents the tape from sticking to itself when the ends 40 of the tape are folded for packaging as shown in FIGS. 2 and 3.

As set out hereinabove, the splice tape 38 is oriented on work surface 36 so that the length of the tape extends across the work surface in the same direction as the edge 30 to which flap 32 is attached. This orients the tape generally transverse the direction in which the casing is dispensed from the carton and generally parallel to the leading edge 52 (FIG. 4) of the casing within the carton (and also parallel to the trailing end of the casing).

Figure 4:
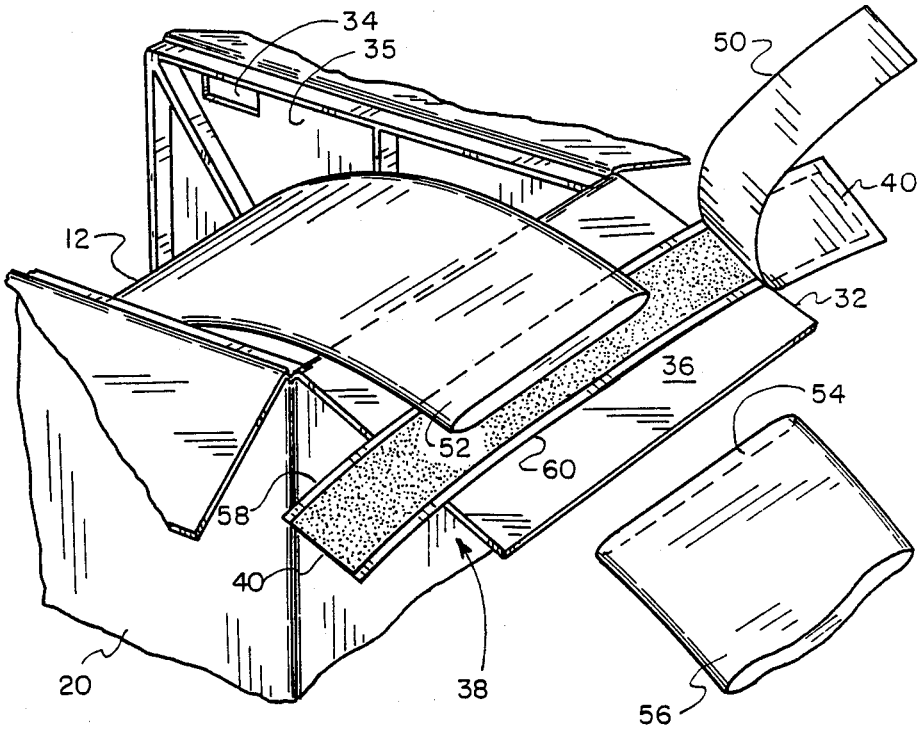
FIGS. 4 and 5 are fragmentary views on an enlarged scale illustrating the steps for effecting a splice utilizing the package casing article of the present invention.
Figure 5:
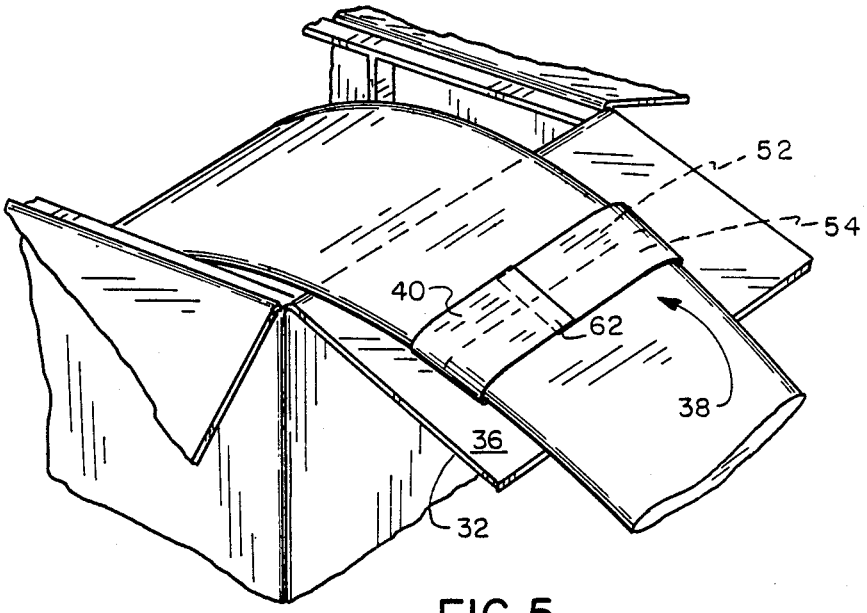

The method of effecting the splice is illustrated in FIGS. 4 and 5. FIG. 4 shows a new carton 20 containing a full roll 12 of casing. The leading end 52 of the full roll within the carton is to be spliced to the trailing end 54 of a casing length 56 from a roll (not shown) about to run out. The splice is made before the trailing end 54 enters the feed roll system of the stuffing machine so it will not be necessary to stop the stuffing machine and lace the leading end 52 of the new roll of casing through these feed rolls. Thus, the trailing end 54 is removed from its reel and is made available for splicing before it enters the machine feed roll system of the stuffing machine.

To effect the splice, the operator, without disturbing the relative position of splice tape 38 with respect to flap 32, peels away the release lining 50. The operator then draws the leading end 52 of the casing from the new roll, locates this end intermediate the longitudinal edges 58,60 of the tape, and then presses the casing end against the tape to adhere the leading end to the splice tape. The flap can be held in an open position when pressing tbe casing against the tape. An alternative to holding the flap is to locate a second carton (not shown) adjacent carton 20 and then to fold the flap 32 over so it rests atop the second carton.

Next, the trailing end 54 of casing length 56 is aligned with end 52 and is pressed against the adhesive tape to adhere it to the tape. The two ends 52,54 can be butted together for splicing or they can be telescoped together.

It should be appreciated that pressing the ends 52,54 against the tape 38 is accomplished by pressing them against the work surface 36 of flap 32. Since the tape is adhered to the work surface, the work surface maintains the defined orientation of the tape and keeps the tape in a flat condition to facilitate the pressing of the casing ends 52,54 against the tape 38.

To complete the splice, the two ends 40 of the tape are wrapped around the flat width of the casing as shown in FIG. 5 and are pressed downward against the casing ends 52,54 and the work surface 36 to firmly adhere the tape to both casing ends. Preferably the length of the splice tape is slightly longer than twice the flat width of the casing so that there is a slight overlapping of the tape ends 40 as shown at 62. After the splice is made, the operator pulls upward on the spliced casing to release it from the work surface 36.

As mentioned hereinabove, the operator generally wears gloves which interfere with the sense of touch and the operator's manual dexterity. Accordingly, by having the splice tape 38 preoriented and supported on the work surface 36 of end flap 32, excessive operator manipulations of the tape and the casing ends are eliminated. This facilitates making the splice. The ends of the casings to be spliced are simply brought to the splice tape for pressing against the tape and then the ends of the tape are folded over and are pressed against the casing. Carton end flap 32 performs important dual functions in making the splice in that the flap both supports the tape 38 in a proper orientation for splicing and it provides a work surface 36 against which the ends of the casing are pressed for joining to the splice tape.

While the end flap 32 has been described as a means to at least partly close the carton, the flap can be used for the sole purpose of carrying the splice tape and providing a work surface as described hereinabove. In this embodiment, the carton would be provided with other closure means such as a removable cover.

It should be appreciated that the order of attachment of the casing ends 52,54 to the splice tape is not critical. For example, the trailing end 54 can be attached first or the leading and trailing ends can be telescoped together and then pressed against the splice tape. Also, the splice tape 38 can be releasably attached to either end flap 32 so long as the tape is oriented generally transverse the dispensing direction. Moreover, while the casing has been described as being rolled flat stock, it should be appreciated that the casing can be arranged in folded layers or corrugations within carton 20 for continuous dispensing.

Having thus described the invention in detail what is claimed as new is:

1. A packaged food casing article comprising:

(a) a dispensing carton having a bottom, two side walls, and two end walls upstanding from about the periphery of said bottom and an open top;

(b) a flap attached to and extending along an upper edge of one of said end walls, said flap being foldable along the attached upper edge between an open and a closed position;

(c) said flap having a flat work surface which faces into said carton when said flap is in said closed position and which faces out of said carton when said flap is in said open position;

(d) a supply of flattened food casing in said carton arranged for continuous dispensing through said open top and over an upper edge of one of said end walls;

(e) a strip of pressure sensitive adhesive splice tape at least twice as long as the flat width of said casing, said tape including a backing which has one face releasably attached to said work surface and an adhesive layer on an opposite face, said strip of tape extending in its longitudinal direction across said work surface generally parallel to said attached upper edge and transverse to the dispensing direction of casing from said carton; and (f) a release lining over said splice tape which is removable when said flap is in said open position to expose the adhesive layer of said tape for adhesive attachment to an end of said casing dispensed from said carton and pressed against said tape and work surface.

2. A packaged food casing article as in claim 1 wherein said flap comprises a portion of a closure means for said carton open top.

3. A packaged food casing article as in claim 1 wherein said casing is arranged for dispensing over said flap.

4. A packaged food casing article as in claim 1 wherein said supply of casing comprises at least 1,000 feet of casing reeled or folded in corrugations to fit within said carton.

5. A packaged food casing article as in claim 1 wherein said supply of casing is contained in a roll, and a frame within said carton rotatably supporting said roll.

6. A packaged food casing article as in claim 5 wherein said frame includes an end plate disposed in said carton adjacent each of said upstanding side walls, said end plates each having a means for gripping by hand adjacent an upper end thereof and said carton side walls each having an opening adjacent an upper edge thereof aligned with said gripping means whereby said gripping means are accessible through said openings in said side walls.

7. A packaged food casing article comprising:

(a) a dispensing carton having a bottom, two side and two opposite end walls upstanding from about the periphery of said bottom and an open top;

(b) closure means for said open top including a flap attached to and extending along an upper edge of at least one of said end walls, said flap being foldable along the attached upper edge to at least partly close said open top;

(c) said flap having one surface thereof defining a flat work surface which faces into said carton when said flap is folded to a closed position and which faces out of said carton when said flap is folded to an open position;

(d) a casing supply in said carton composed of at least 1,000 feet of flattened tubular casing reeled or folded in corrugations to fit within said carton and arranged for continuous dispensing through said open top and over an upper edge of one of said end walls, said casing length having a leading end which is first to be dispensed and a trailing end which is last to be dispensed;

(e) a strip of a pressure sensitive adhesive tape carried by said work surface including a backing and a pressure sensitive adhesive layer on one face of said backing, the length of said strip of tape being at least twice the flat width of said casing;

(f) means releasably securing said strip of tape to said work surface so that said tape extends in its lengitudinal direction across said work surface in tbe same direction as said attached edge with said adhesive layer facing out from said carton when said flap is folded to its open position; and (g) a release lining over said adhesive layer and being peelable from said adhesive layer when said flap is in an open position to expose the adhesive layer to permit (i) the pressing of one of said casing ends to said adhesive layer and against said flat work surface for adhering to said adhesive layer intermediate the longitudinal edges of said strip of tape, and (ii) the wrapping and pressing of said strip of tape around said one end of said casing at said work surface, whereby said one end of said casing is joined at said flat work surface to an end of a second casing length;

8. A packaged food casing article as in claim 7 wherein said casing supply is a roll, and a frame within said carton rotatably supporting said roll.

9. A packaged food casing article as in claim 8 wherein said frame includes spaced end plates positioned adjacent the opposite side walls of said carton, and said end plates and side walls each having aligned openings adjacent an upper end thereof to permit simultaneous manual grasping of said end plates and said carton for lifting said carton and its contents.

10. A packaged food casing article as in claim 7 wherein said casing is arranged for dispensing over said work surface.

* * * * *